United States Patent [19]

Toeppen

[11] 4,064,984

[45] Dec. 27, 1977

[54] FASTENING DEVICE FOR PRINT HEAD

[76] Inventor: Thurston H. Toeppen, R.D. 3 - Lois Lane, Poughkeepsie, N.Y. 12603

[21] Appl. No.: 731,718

[22] Filed: Oct. 12, 1976

[51] Int. Cl.[2] ..... B41J 1/60

[52] U.S. Cl. ..... 197/52; 197/55

[58] Field of Search ..... 197/16, 18, 52, 55; 24/211 K, 211 L, 211 M

[56] References Cited

U.S. PATENT DOCUMENTS

| | | | |
|---|---|---|---|
| 3,001,628 | 9/1961 | Rice | 197/52 |
| 3,307,677 | 3/1967 | Frank et al. | 197/52 |
| 3,658,162 | 4/1972 | van der Werff | 197/16 X |
| 3,800,934 | 4/1974 | Decker | 197/52 |
| 3,826,345 | 7/1974 | Miller | 197/52 |
| 3,842,959 | 10/1974 | Bauer | 197/52 |

*Primary Examiner*—Paul T. Sewell

[57] ABSTRACT

Releasable device for fastening a unitary typewriter print head or other printing device to its mounting are disclosed. A manually-operated control lever on top of the print head effects the closing or opening of a pair of locking levers, to engage them with or release them from a retaining groove in the mounting post. The locking arms are displaced toward or away from the retaining groove by cam action in the form of journal bearings in the control lever, which are rotated in a conical path with respect to the pivot axis of the lever.

6 Claims, 10 Drawing Figures

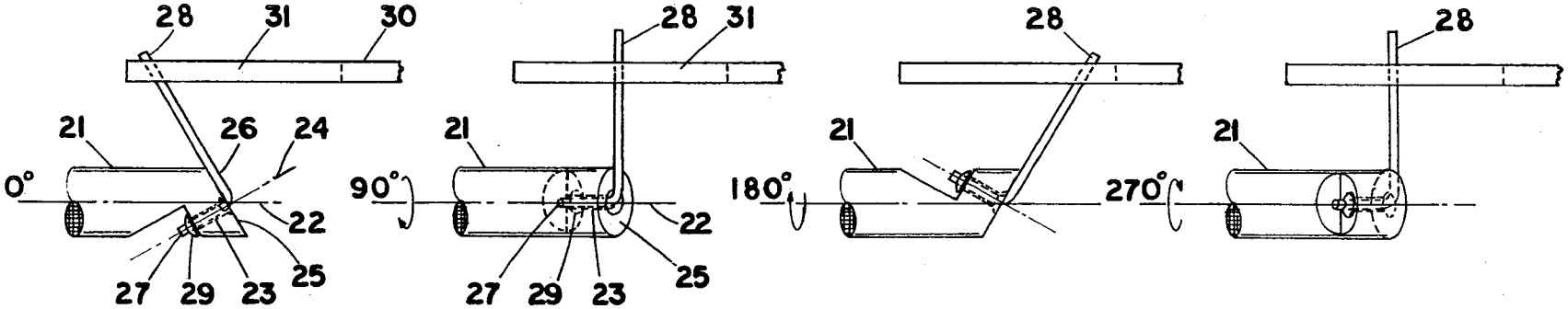
FIG. 5
FIG. 6
FIG. 7
FIG. 8
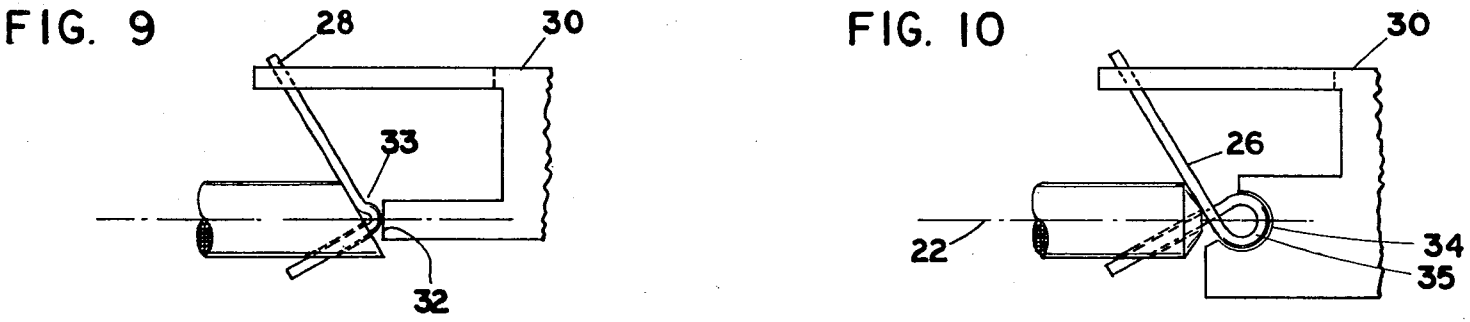
FIG. 9
FIG. 10

FASTENING DEVICE FOR PRINT HEAD

BACKGROUND OF THE INVENTION

In typewriters of the unitary or single-element print head class, all of the characters to be printed are embossed on the surface of a single substantially-spherical, or cylindrical, member which is moved in such a way as to present a desired character at the printing point when called for. One of the principal advantages of this form of typwriter is the facility with which different fonts of characters may be made available by simply replacing one print head with another. To this end, it is important to provide means for fastening the print head to its mounting post which (*a*) will hole the head in place firmly when locked, and (*b*) may be easily operated to install or remove a head. Other desirable features are (*c*) minimum mass, to reduce inertial loads during operation, (*d*) means for handling the print head in a clean and safe manner while installing or removing it, (*e*) low manufacturing cost, and (*f*) attractive appearance.

The fastening device shown in U.S. Pat. No. 3,307,677, meets some of these requirements adequately but not others. It is not easily operated especially when removing it from the mounting post, since it employs unfavorable pressure angles and very small contact surfaces between the cam actuator and the wire locking spring; this results in considerable friction between them during opening and closing, which can be only slightly alleviated by lubrication. This is further aggravated by the fact that the critical locking action takes place at the weakest point of spring deflection, so that the frictional load on the mating parts increases constantly during the procedure of unlocking, requiring a substantial, and quite variable, unlocking force. In addition, the same device incorporates a relatively large, hardened steel cam member (see column 4, lines 3–5 of U.S. Pat. No. 3,307,677), which undesirably increases the inertial mass of the print head. Finally, the size of the cam member requires the use of a protuberant hinge area which occupies a substantial part of the top surface of the print head, thereby impairing the appearance of the head and restricting both the decorative and informative design of the surface.

The several other forms of prior art design have been marked by comparable deficiencies in one or more of the categories listed above, although the specific disadvantages of the other designs are different in each case.

SUMMARY OF THE INVENTION

The fastening device of the present invention is designed to be part of a truncated spherical print head, provided with embossed characters on its outer surface, of the kind used in a number of current makes of typewriters and other serial, or character-by-character printers. Such a print head is designed to be mounted on a post which is a part of the permanent printing mechanism of the typewriter, and which during operation is rotated and tilted in such a way as to successively present the desired embossed characters at the printing point. To that end, the lower part of the mounting post is provided with a first abutment surface in the form of an annular shoulder, to support the print head, and with a first indexing element in the form of one or more radial pins, to establish the angular position of the print head; the upper end of the post is typically provided with a circumferential groove to receive means for locking the print head to the post; though other retaining means than the circumferential groove have sometimes been used. The print head is correspondingly provided with an axial hole terminated by a second abutment surface, in the form of an annular shoulder at its lower end to mate with the shoulder of the post; the shoulder is interrupted by one or more second indexing elements in the form of radial notches or grooves to mate with the pin or pins of the post.

The invention is disclosed herein in terms of a fastening means for locking the print head to a circumferential groove on a post. The invention is not restricted to this embodiment, since the elements of its construction may be used in many other circumstances where it is desired to actuate one or more levers or shafts in certain directions under restricted space, weight and/or cost conditions.

The invention consists of a simple, compact, and efficient arrangement of parts for converting rotary motion about one axis into oscillating motion about an intersecting, perpendicular, second axis, or vice versa. To accomplish this end, the parts are arranged in such manner that it would not be obvious to expect such a result from such an arrangement.

The present embodiment utilizes two oscillating elements, in the form of locking levers made of steel wire, for engaging the circumferential groove of the mounting post. The long arms of the levers engage the circumferential groove, their fulcrums are pivoted in recesses in the molded plastic cover, and the short arms of the levers are journaled in bearing holes in a control lever or handle. The bearing holes are inclined at certain angles to the effective axis of rotation of the control lever so that the long arms of the locking levers are caused to diverge to an unlocked condition when the handle is in its vertical position, and to converge to lock into the circumferential groove of the mounting post when the control lever is in its horizontal position. In addition, the short arms in the bearing holes cooperate with each other to support the actuating lever and to provide a virtual pivot axis for it, thereby eliminating the need for separate pivot means.

The two locking levers carry no load and are unstressed in the unlocked condition, and while moving toward the locked condition; it is not until the long arms make contact with the locking surface of the circumferential retaining groove that locking pressure and stress is developed. In addition, the short lever arms, which are the source of the locking force on the long arms, can be journaled in closely-fitted bearing holes. Lubrication, if needed at all, is easily retained. As a result of these features, the actuating force is applied with high efficiency, so that operation of the device is very smooth during both locking and unlocking.

Since all of the parts except the small wire locking levers may be made of molded plastic material, both the cost and the inertial mass are relatively low. The exposed top surface of the device, when the head is locked in place, has no protuberances other than those which may be added for decorative effect.

In addition to the features noted above, supplementary means have been incorporated for retaining the control lever in its limiting open and closed positions.

BRIEF DESCRIPTION OF THE DRAWINGS

FIG. 5 is a segmentary view of an alternate form of my invention;

FIGS. 6 through 8 are segmentary views of the lever arm shown in FIG. 5 in various positions of rotation such as 90°, 180°, and 270° respectively;

FIG. 9 is a segmentary view of a variation of the invention shown in FIG. 5; and FIG. 10 is a segmentary view of a further modification of the invention shown in FIG. 5.

DESCRIPTION OF THE PREFERRED EMBODIMENTS

As shown in FIGS. 1–4, in its preferred form, the device comprises a cover 1 which is molded of a suitable plastic material, and which is affixed to the top of a truncated spherical type element or print head 2 by means of three or more plastic studs (not shown) which are integral with cover 1.

A control lever or handle 3, molded of a suitable plastic material, is set into a slot in cover 1 in such manner that one end 3′ is pivotally held in the body and the other end 3″ is free to be raised from a horizontal position, in which the print head 2 is locked to its mounting post 4, to an approximately vertical position, in which the print head is unlocked so that it may be removed from post 4 (or vice versa).

Figure 1:
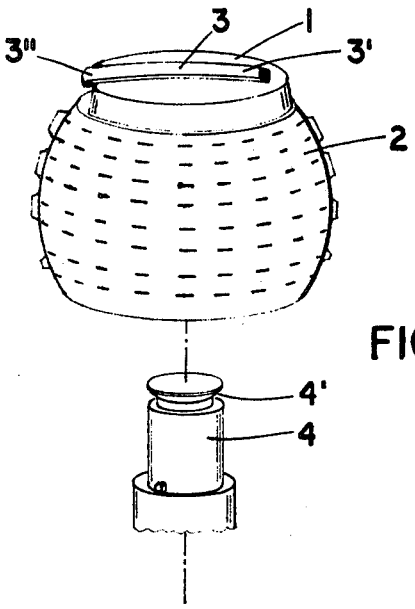
FIG. 1 is an exploded perspective view of a typewriter print head and post.
Figure 2:
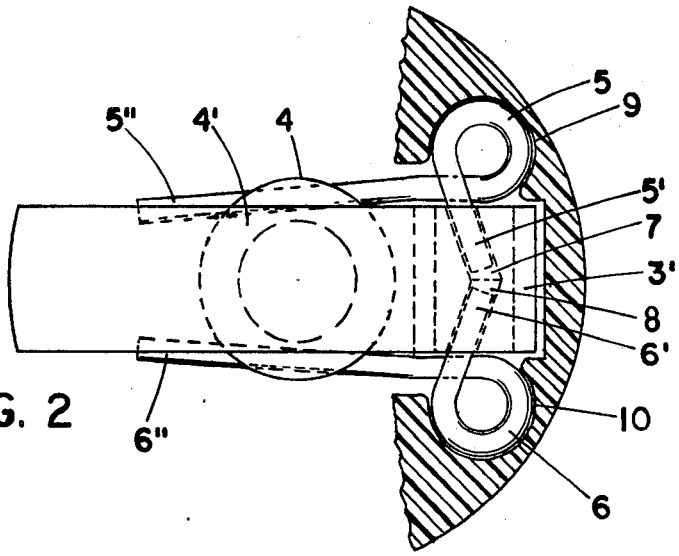
FIG. 2 is a segmentary view from above of the typewriter print head when maintained in position on a typewriter by my improved locking device.

As shown in FIG. 2, lever end 3′ interacts with a pair of locking levers in the form of steel wire spring members 5 and 6 to provide both pivot means for lever 3 and crank means for locking levers 5 and 6.

Lever end 3′ is provided with a pair of transverse bearing holes 7 and 8 each of which, as shown from the top in FIG. 2, is inclined away from the center of lever 3 at an angle of approximately 20° with respect to the effective pivot axis of lever 3; they lie in a common plane, and the ends of the holes may meet at the center but do not have to. As viewed from the side, (FIG. 3) holes 7 and 8 are approximately parallel to the general plane of lever 3: they may, however, be angled slightly for reasons to be described later.

Levers 5 and 6 are made of round wire, and each consists of a single loop or wire with one short arm (5′,6′) and one long arm (5″, 6″). The loop of spring 5 is wound with a right-hand helix and that of spring 6 with a left-hand helix.

The loop of each spring is retained in a closelyfitting recess (9,10) molded into the plastic material of cover 1, so that the loops are free to rotate or tilt within their normal limits of operation, but not beyond.

The angle between the two ends of each spring is such that when the short arms of the springs 5′, 6′ are journalled in the closely-fitted holes, 7,8, long arms 5″, 6″ will be forced between the conical upper surface of locking groove 4′ and the top surface of type element 2.

In order to unlock the device, to remove the print head from the post 4, lever 3 is raised from the horizontal to approximately the vertical position by lifting end 3″ around short lever arms 5′, 6′ which act as pivots. This causes the common plane of holes 7 and 8 to be rotated by about 90° so that arms 5′, 6′ will then be aligned in a vertical plane rather than in a horizontal plane as before. This has the effect of simultaneously rotating and tilting the springs in recesses 9,10. The rotation causes long arms 5″, 6″ to separate enough to permit removal of the print head from post 4; the tilting motion may be used to provide a detent action for the open position of lever 3, as decribed below.

Figure 3:
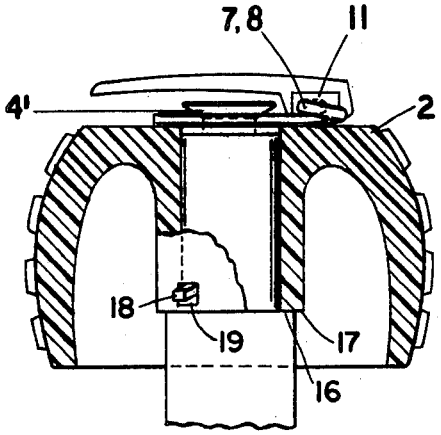
FIG. 3 is a side view of the control lever of my invention with the type element shown locked to the mounting post.

Since the locking force required at each point of application to the mounting post is nearly two pounds, the force which must be applied to the short arms of the locking levers is considerably greater than that, and could at certain points exceed the strength of some plastic materials which might be otherwise suitable for lever 3. For this reason it may be desirable to provide a metal insert 11 to carry the pivot holes, as shown in FIG. 3. The insert will then support within itself almost all the working load, with only a small, well-distributed portion of it transmitted to recesses 9,10 and other plastic parts of the device.

Figure 4:
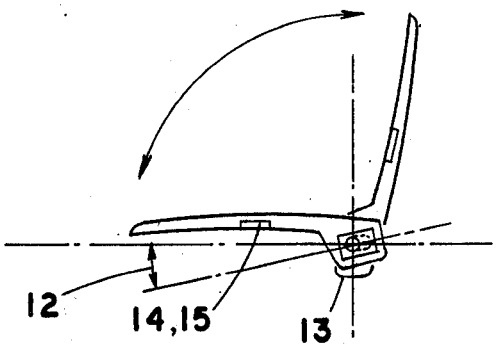
FIG. 4 is a side view of the control lever of FIG. 3 showing it in open and locking positions.

In order to permit lever 3 to open to a position beyond the vertical, if desired, the common plane of holes 7,8 may be inclined by several degrees, as shown at 12 in FIG. 4; the presence of this over-center angle also tends to hold lever 3 down when in the locked position, by moving levers 5, 6 just beyond the point of maximum locking pressure. Also, by suitable design of the heel 13 of lever 3, and related parts, a detent action for the open position of lever 3 can be secured from the tilting motion of springs 5,6.

In order to hold lever 3 more positively in its locked or horizontal position, a pair of detents 14,15 may be molded on the sides of lever 3, to cooperate with mating recesses molded on the sides of the slot in cover 1 (not shown). Additional provisions for supporting and orienting print head 2 on mounting post 4 are shown in FIG. 3. The lower part of the post is provided with an abutment surface in the form of an annular shoulder 16, to support the lower abutment surface 17 of the print head. When locked in place on the post, the print head is clamped between shoulder 16 and conical surface 4′. Immediately above shoulder 16 there is a radial pin or first indexing means 18, fixed on the post 4 and positioned to cooperate with a mating notch or second indexing means which is slot 19, which interrupts abutment surface 17, to establish the angular position of the print head with respect to the post.

An alternate embodiment of the device is shown in FIG. 5 and comprises an input shaft which is rotatable about its axis 22 in either direction. At the end of shaft 21 is a bearing hole 23, the axis 24 of which intersects axis 22 beyond the end of the shaft, at any desired angle up to a maximum of about 45°. The end of shaft 21 terminates in a plane surface 25, perpendicular to axis 24.

A bent lever 26, having a bearing arm 27 and an actuating arm 28, both of which have round cross-sections, is positioned with the short arm journaled in bearing 23; it is held in the bearing by a suitable retainer 29, or its extending end may be crimped or curled to retain the lever. A fixed member 30 provides a slot 31 to guide the outer end of arm 28.

Preferably, axes 22 and 24 and the axis of arm 28 should intersect at a common point, axis 22 should lie in the plane of slot 31, and the angle between arms 27 and 28 should be 90°; however, small departure from these conditions can be accommodated with some loss of precision.

In operation, rotation of shaft 21 causes oscillation of lever arm 28, as shown in FIGS. 6,7 and 8. Taking the condition of FIG. 5 as representing 0° shaft rotation, FIG. 6 represents 90° rotation, with surface 25 then facing the viewer. Short lever arm 27 rotates with shaft 21, following a conical path, and is seen in FIG. 6 as being in the same plane as axis 22. Long arm 28, however, is constrained by slot 31 and so connot rotate with shaft 22; instead it rotates about its own axis through an angle which is equal to the angle between axes 22 and 24, and moves along slot 31 to a position where it is perpendicular to axis 22. During this action, short arm 27 rotates in bearing 23. In effect, bearing 23 and slot 31 act as cams to direct long arm 28 into a fan-like oscillatory motion, while surface 25 and retainer 29 prevent axial sliding of arm 27.

Further rotation of shaft 21 to the 180° position (FIG. 71) rocks along arm 28 to its extreme right-hand position.

Further rotation of shaft 21 to the 270° position (FIG. 8) returns long arm 28 to a condition which is equivalent to FIG. 6, except that the trasient rotation of arm 28 about its own axis is in the opposite direction.

It is therefore seen that continuous rotation of shaft 21 in either direction causes arm 28 to ascillate in slot 31. The precision of the output motion is governed only by the accuracy of the parts and clearances. If low-friction plastic materials are used for bearing 23, surface 25 and guide member 30, and a suitable wire material for lever 25, high accuracy can be secured at relatively low cost.

The action may be reversed, with arm 28 serving as the input and shaft 21 as the output; however, this introduces deadcenter conditions at 0° and 180°, which must be allowed for.

A variation of the FIG. 5 construction is shown in FIG. 9. Retainer 29 is eliminated, and is replaced by a thrust bearing surface 32, which may be a part of support member 30. An offset 33 is added to arm 28 to prevent interference with surface 32 during the 180° condition shown in FIG. 7.

Another variation is shown in FIG. 10. In this version, surface 32 is replaced by a recess 34 in member 30, which receives a loop 35 formed in lever 26. The loop, in addition to the function of controlling the position of lever 26 during its complex motion, offers different spring rate and load characteristics than those of the FIG. 5 or FIG. 9 constructions, if they should be needed in a particular application. In this version, the location of axis 22 cannot be fixed, but must have some freedom to shift its position during operation.

What I claim is:

1. A releasable fastening device for fastening a unitary print head to a projecting mounting post provided with first indexing means, an abutment surface and a circumferential groove comprising:

said print head having a plurality of type characters embossed on its periphery and an axial hole formed therein for slidable positioning on said mounting post;

second indexing means formed on said head to mate with said first indexing means on said mounting post for predetermined relative angular positioning of said print head with respect to said mounting post;

an annular shoulder formed on said print head to mate with said abutment surface of said mounting post to limit the axial position of said print head in a first direction;

manually-controllable locking means operatively associated with said print head for cooperating with said circumferential groove in said mounting post to limit the axial position of said print head in a second direction, comprising locking members in the form of one or more bent levers, each of said bent levers being capable of pivotal movement between an unlocked position out of said groove in which each of said bent levers is unstressed, and a locked position in which each of said bent levers is deflected into a stressed position within said groove, and control lever means capable of pivotal movement between corresponding unlocked and locked positions, said control lever means being provided with journal bearing means intersecting its effective pivot axis at an acute angle for moving said locking means between the unlocked and the locked positions.

2. A fastening device as in claim 1, in which said bent levers are constructed of spring wire, a first arm of each of said bent levers for engaging said circumferential groove, a second arm of each of said bent levers substantially perpendicular to said first arm, and pivoting means at the juncture of said first and second arms to allow angular movement of said first arm between unlocked and locked positions, said pivoting means consisting of a wire loop which is free to move in a closely-fitted recess formed in said print head.

3. A fastening device as in claim 2 in which said control lever means provides a closely-fitted bearing hole to receive said second arm of each of said bent levers, said bearing hole being angled for rotation in a conical path during rotation of said control lever means about an axis between its unlocked and locked positions, and said bearing hole being in substantially the same plane as said circumferential groove, said first bent lever arm, and said control lever means axis in the locked condition thereof; and said bearing hole being in a second plane substantially perpendicular to the first plane and passing through said control lever means axis in the unlocked condition thereof.

4. A fastening device as in claim 3, in which the plane defined by the said angled bearing hole and the effective pivot axis of said control lever means is moved into an overcenter condition, near the end of the locking operation, in order to produce positive seating of said control lever means.

5. A fastening device as in claim 3, in which a pair of said angled holes interacts with said second arms of said bent levers to provide mutual support for the creation of an effective pivot axis for said control lever means in the absence of separate pivot means.

6. A fastening device as in claim 1, in which said bent levers are constructed of spring wire of circular cross section, a first arm of each of said bent levers for engaging said circumferential groove, a second arm of each of said bent levers substantially perpendicular to said first arm, said arms being separated by a bend of said wire, said first arm being movable relative to said second arm due to the resiliency of said wire between said unlocked and said locked positions.

* * * * *